US005614069A

United States Patent [19]

Lin

[11] Patent Number: 5,614,069

[45] Date of Patent: Mar. 25, 1997

[54] APPARATUS FOR PRODUCING ELECTROLYTICALLY AND COLLECTING SEPARATELY TWO GASES

[76] Inventor: I-Chuan Lin, Yueh-Mei-Tan No. 53, Yueh-Tan Tsun, Hsin-Kang Hsiang, Chia-Yi Hsien, Taiwan

[21] Appl. No.: 662,822

[22] Filed: Jun. 12, 1996

[51] Int. Cl.[6] ..... C25B 9/00; C25B 15/08

[52] U.S. Cl. ..... 204/268; 204/270; 204/278; 204/274

[58] Field of Search ..... 204/262, 263–266, 204/253–258, 270, 268, 274

[56] References Cited

U.S. PATENT DOCUMENTS

| | | | |
|---|---|---|---|
| 4,113,601 | 9/1978 | Spirig | 204/270 X |
| 4,206,029 | 6/1980 | Spirig | 204/270 X |
| 4,336,122 | 6/1982 | Spirig | 204/270 X |
| 4,450,060 | 5/1984 | Gonzalez | 204/268 |
| 4,457,816 | 7/1984 | Galluzzo et al. | 204/270 X |
| 4,726,888 | 2/1988 | McCambridge | 204/270 X |
| 5,082,544 | 1/1992 | Willey et al. | 204/270 |
| 5,480,515 | 1/1996 | Gallien | 204/270 X |

*Primary Examiner*—Donald R. Valentine
*Attorney, Agent, or Firm*—Brumbaugh, Graves, Donohue & Raymond

[57] ABSTRACT

An apparatus for producing electrolytically and collecting separately two gases includes an electrolytic tank, a power supply unit, and two gas tanks. The electrolytic tank has a casing with an open top, a plurality of electrode plates which are spaced parallelly in the casing and which are connected electrically to the power supply unit, and a lid member disposed on the open top of the casing. The lid member has first and second cavities in its upper face and a plurality of partition plates and press plates depending alternatively from its lower face. A plurality of clearances are formed between the partition and press plates. Each of the press plates abuts against a top edge of a respective one of the electrode plates. The first and second cavities are formed respectively with a plurality of first and second through holes which are staggered with one another so that the first and second cavities can be communicated alternatively with the clearances. The gas tanks are connected receptively to the first and second cavities. An electrolytic solution is received in the casing so that the electrode plates can be immersed fully in the electrolytic solution.

5 Claims, 8 Drawing Sheets

APPARATUS FOR PRODUCING ELECTROLYTICALLY AND COLLECTING SEPARATELY TWO GASES

BACKGROUND OF THE INVENTION

1. Field of the Invention

This invention relates to an apparatus for producing electrolytically two gases, more particularly to an apparatus for producing electrolytically and collecting separately two gases.

2. Description of the Related Art

Referring to FIG. 1, a conventional apparatus for producing electrolytically two gases, for example, hydrogen and oxygen, is shown to comprise an electrolytic tank 11 which has two electrode rods 110 that are connected electrically to the negative and positive poles of a rectifier unit 10 which is in turn connected to a power supply unit 1. The electrolytic tank 11 contains an electrolytic solution 112 such that the electrode rods 110 can be immersed in the electrolytic solution 112. A water-closed type backfire safety device 12 is connected to a gas outlet 113 of the electrolytic tank 11. A pressure regulator 15 and a pressure gauge 151 are connected downstream of the backfire safety device 12 through a pipe in order to maintain the pressure of the gas which is produced in the electrolytic tank at a constant level. A dryer 16 is connected to the pressure regulator 15 through the pipe. A burner 18 is connected to dryer 16 via ball-valve type backfire safety device 17. When in use, hydrogen and oxygen gases are produced electrolytically in the closed electrolytic tank 10. The working pressure of the hydrogen and oxygen gases is set by means of the pressure regulator 15. Although the conventional apparatus is useful to produce and collect hydrogen and oxygen gases, the hydrogen and oxygen gases cannot be collected separately. In addition, the amount of hydrogen and oxygen gases produced is limited because of the small surface area of the electrode rods 110. Therefore, the efficiency of producing the gases is low.

SUMMARY OF THE INVENTION

It is therefore an object of the present invention to provide an apparatus for producing electrolytically two gases and collecting separately the gases which has a high gas-producing efficiency.

According to the present invention, the apparatus is adapted for producing electrolytically two gases and collecting separately the gases and comprises:

an electrolytic tank including a casing having an open top and a receiving space formed therein, a plurality of electrode plates spaced parallelly in the receiving space of the casing in order to divide the receiving space into a plurality of isolated sections arranged side by side in a direction, and a lid member disposed on the open top of the casing in order to close the open top, the lid member having upper and lower faces, elongated, parallel first and second cavities which are formed in the upper face of the lid member and which extend in the direction, each of the first and second cavities having a bottom portion, the lower face of the lid member having a looped wall depending therefrom, a region defined by the looped wall under the lower face of the lid member, a plurality of partition plates and press plates depending parallelly and alternatively from the lower face of the lid member within the region such that a plurality of clearances are formed between the partition and press plates, each of the press plates being aligned with and abutting against a top edge of a respective one of the electrode plates, each partition plate having a depth which is larger than a depth of each press plate so as to extend into a respective one of the sections defined by the electrode plates, the bottom portions of the first and second cavities being formed respectively with a plurality of first and second through holes which are staggered with one another so that the first and second cavities can be communicated alternatively with the clearances between the partition and press plates, the lid member further having a cover plate disposed on the upper face of the lid member in order to close the first and second cavities, the cover plate having first and second holes which are communicated receptively with the first and second cavities;

an electrolytic solution contained in the casing so that the electrode plates can be immersed fully in the electrolytic solution;

a power supply unit connected electrically to two of the electrode plates between which the other ones of the electrode plates are located; and two gas tanks, each having a connecting pipe which is connected to a corresponding one of the first and second holes of the cover plate.

In a preferred embodiment, each of the electrode plates is a corrugated plate. The casing has an a plurality of heat-dissipating fins formed on the external face of the casing.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
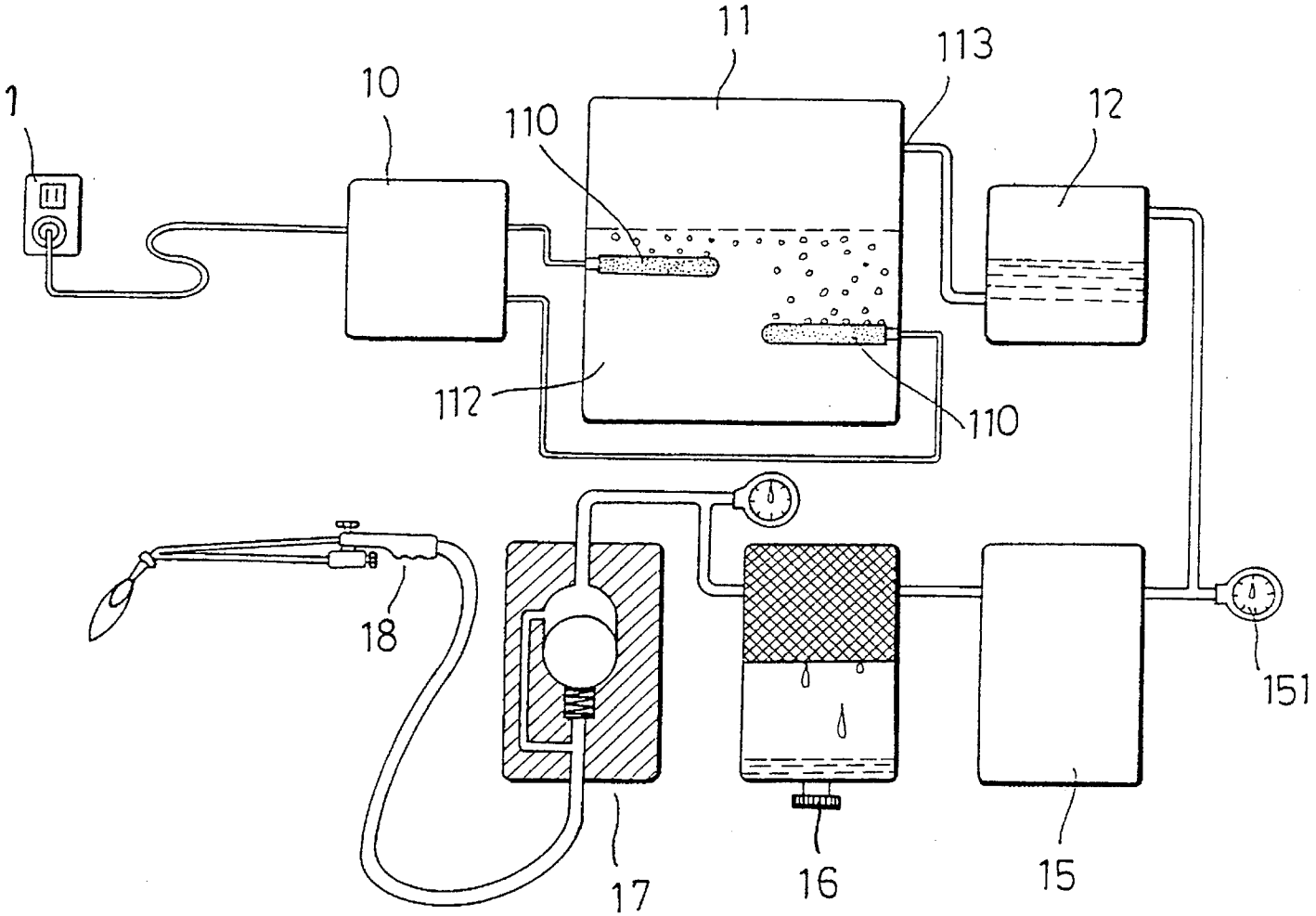
FIG. 1 PRIOR ART
FIG. 1 is a schematic view of a conventional apparatus for producing electrolytically and collecting hydrogen and oxygen gases.
Figure 2:
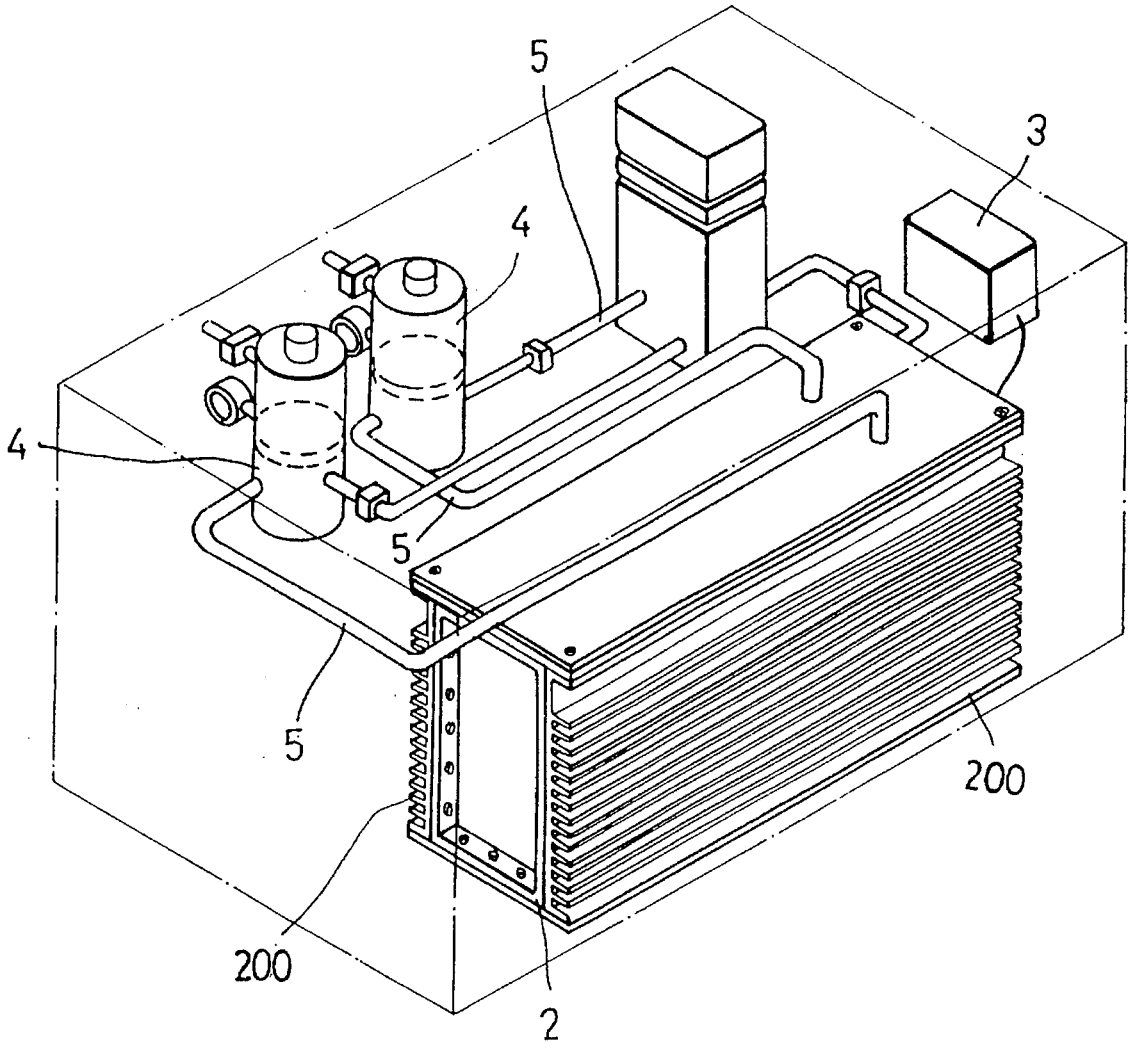
FIG. 2 is a perspective view of a preferred embodiment of an apparatus for producing electrolytically and collecting separately hydrogen and oxygen gases according to the present invention.

Referring to FIG. 2, a preferred embodiment of an apparatus for producing electrolytically and collecting separately two gases, hydrogen and oxygen, according to the present invention is shown to comprise a electrolytic tank 2, a power supply unit 3 and two gas tanks 4. The gas tanks 4 contain desiccants therein and are connected to the electrolytic tank 2 through two connecting pipes 5 in order to collect separately hydrogen and oxygen which are produced in the electrolytic tank 2 by means of electrolysis of an electrolytic solution 6 (see FIG. 6) which is contained in the electrolytic tank 2.

Figure 3:
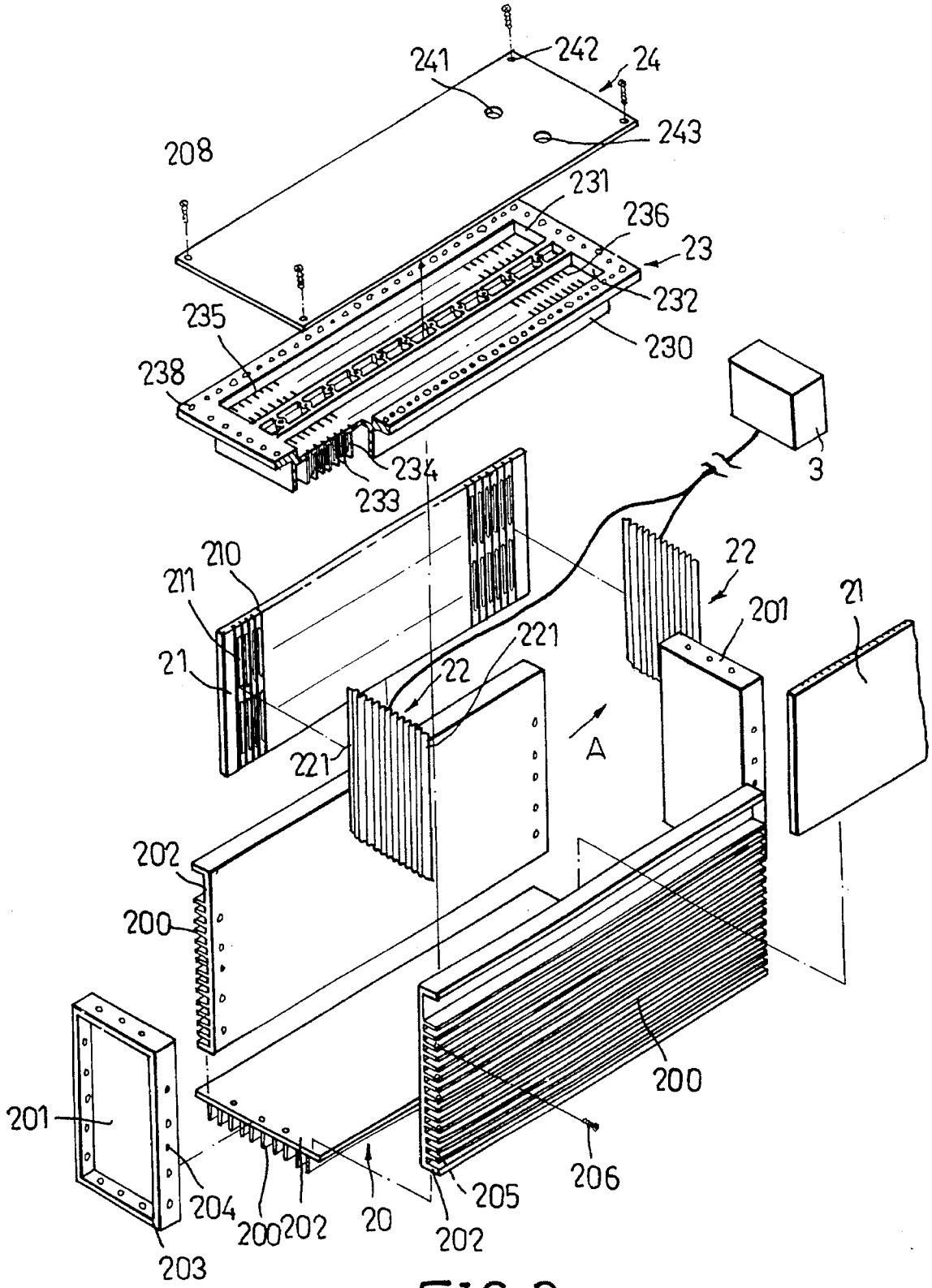
FIG. 3 is a perspective exploded view of an electrolytic tank of the preferred embodiment according to the present invention.

Referring to FIG. 3, the electrolytic tank 2 includes a casing 20, two insulation boards 21, a plurality of electrode plates 22, a lid member 23 and a cover plate 24. The casing 20 has two side plates 201 and three flat panels 202. The edge of each of the side plates 201 has a peripheral connection portion 203 extending outwardly therefrom. The peripheral connection portion 203 of each of the side plates 201 has a plurality of threaded holes 204 formed therein. The edge of each of the flat panels 202 has a plurality of positioning holes 205 which are aligned respectively with the threaded holes 204 so that the side plates 201 and the flat panels 202 can be connected to another by means of screw members 206 in order to form a box with an open top and a receiving space. Two of the flat panels 202 form the vertically opposed side walls of the casing 20. The external face of each of the flat panels 202 is formed integrally with a plurality of heat-dissipating fins 200. Preferably, the casing 20 is made of a material which has a high thermal conductivity. The internal face of the casing 20 is coated with a layer of electrical insulation material. Each of the insulating boards 21 is a rectangular plate and is mounted to a respective one of the opposed side walls of the casing 20. Each of the insulating boards 21 has a plurality of parallel grooves 210 which extend from the top edge to the bottom edge thereof. Each parallel groove 210 of one of the insulating boards 21 is aligned with a corresponding one of the parallel grooves 210 of the other one of the insulating boards 21 so that two opposite edges 221 of each of the electrode plates 22 can be inserted into two aligned parallel grooves 210 of the insulating boards 21 in order to hold the electrode plates 22 in position. Each of the insulating boards 21 has a plurality of apertures 211 which are formed between the parallel grooves 210 for heat-dissipating purposes. Preferably, the insulating boards 21 are made of a chemical and corrosion resistant material. As shown, each of the electrode plates 22 is preferably a corrugated plate.

Figure 4:
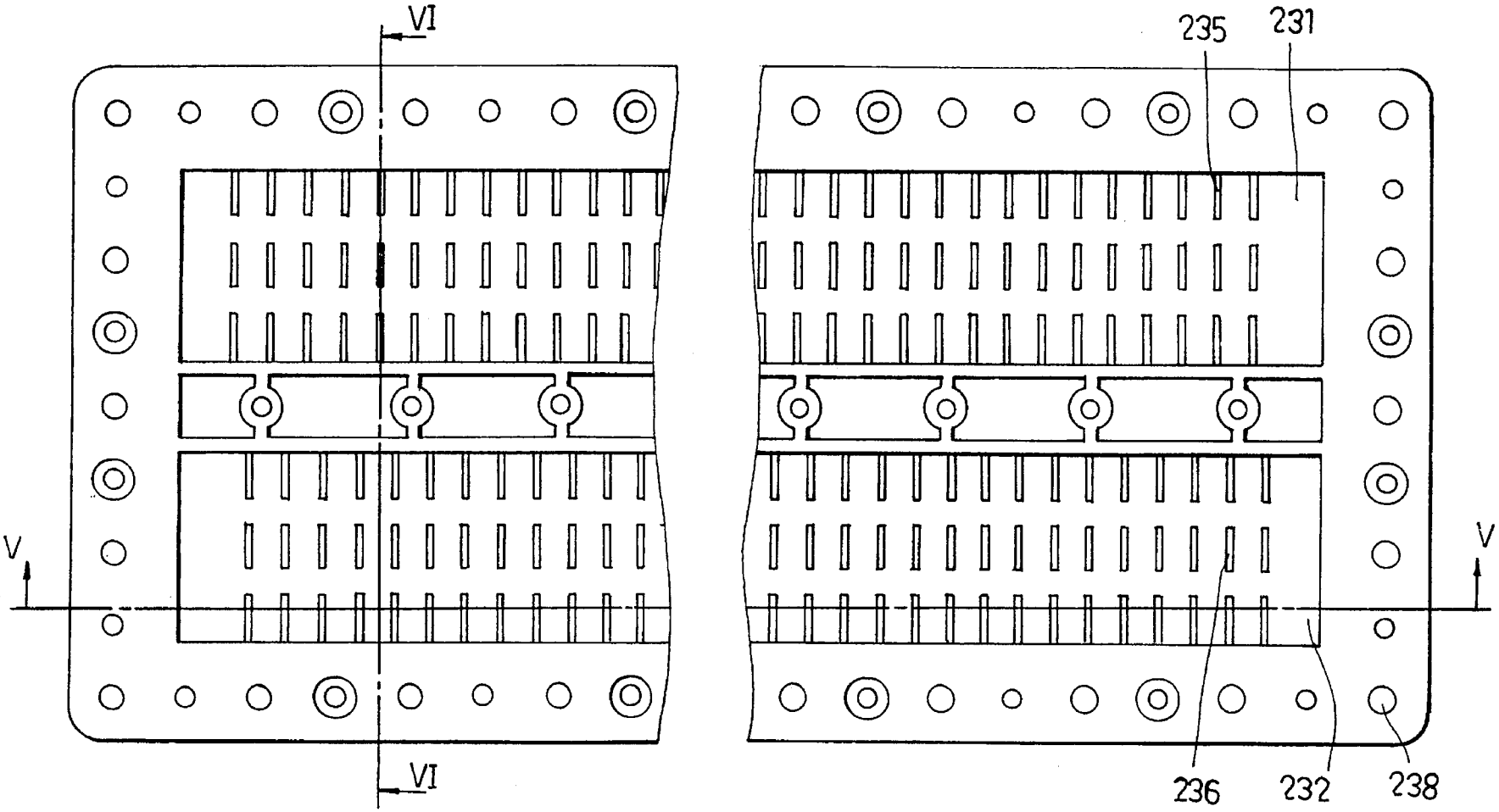
FIG. 4 is a top view of a lid member of the electrolytic tank of the preferred embodiment according to the present invention.
Figure 5:
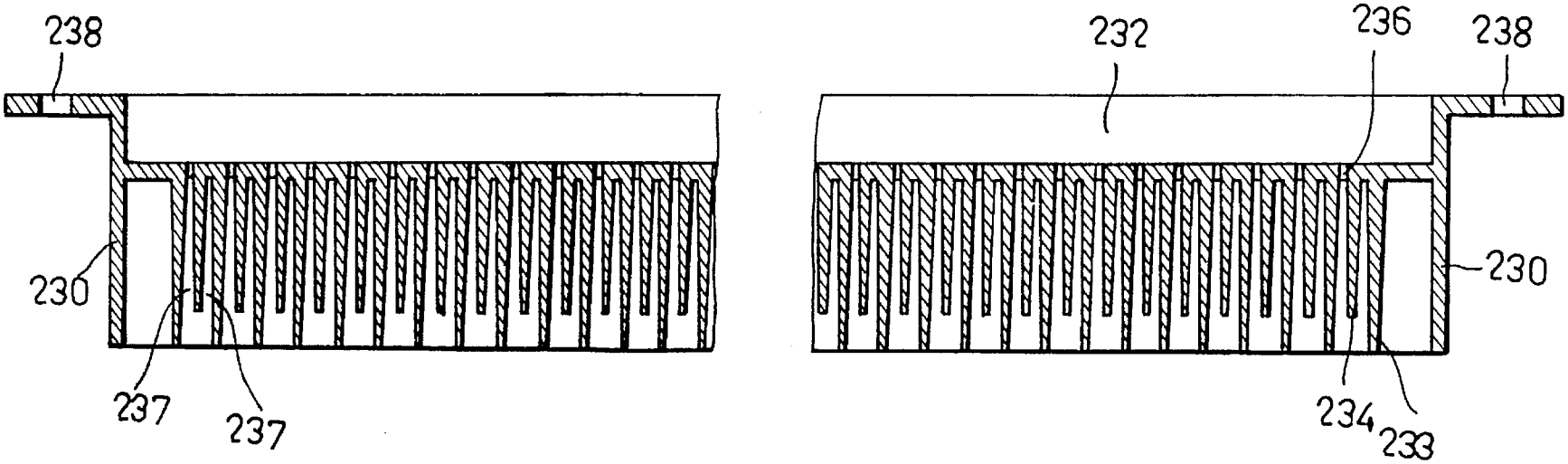
FIG. 5 is a cross sectional view taken along the line V—V of FIG. 4.
Figure 6:
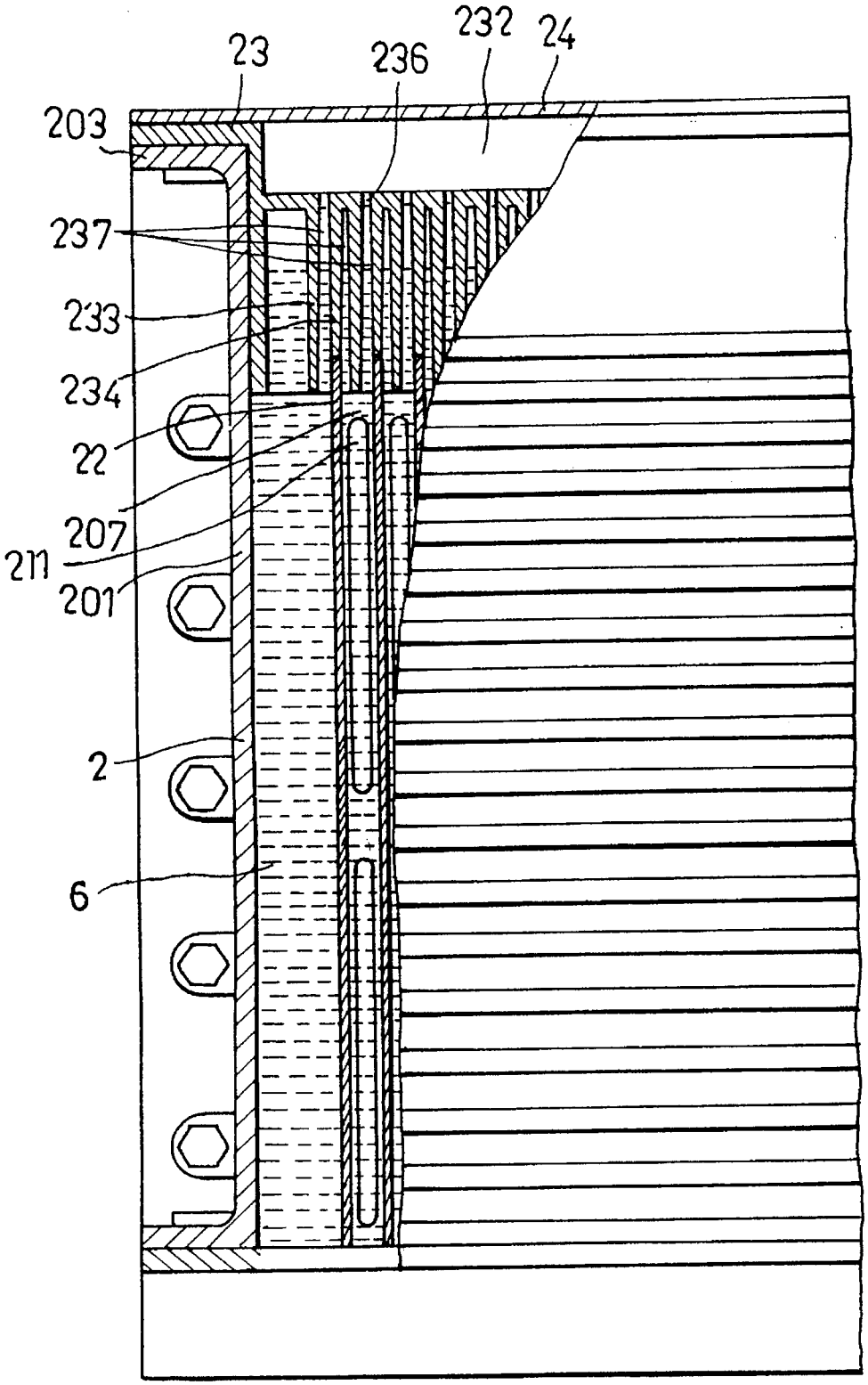
FIG. 6 is a cross sectional view taken along the line VI—VI of FIG. 4.

Referring to FIGS. 3 and 6, the electrode plates 22 are spaced parallelly in the receiving space of the casing 20 in order to divide the receiving space into a plurality of isolated sections 207 arranged side by side in a direction as shown by the arrow (A) of FIG. 3. The lid member 23 is disposed on the open top of the casing 20 in order to close the open top. The lid member 23 has upper and lower faces, elongated, parallel first and second cavities 231, 232 which are formed in the upper face of the lid member 23 and which extend in the direction as shown by the arrow (A) of FIG. 3. The lower face of the lid member 23 has a looped wall 230 depending therefrom, a region defined by the looped wall 230 under the lower face of the lid member 23. A plurality of partition plates 233 and press plates 234 depend parallelly and alternatively from the lower face of the lid member 23 within the region surrounded by the loop wall 230 such that a plurality of clearances 237 are formed between the partition and press plates 233, 234, as best illustrated in FIG. 5. Each of the press plates 234 is aligned with and abuts against the top edge of a respective one of the electrode plates 22. Each partition plate 233 has a depth which is larger than that of each press plate 234 so as to extend into a respective one of the sections 207 defined by the electrode plates 22, as best illustrated in FIG. 6. The bottom portions of the first and second cavities 231, 232 are formed respectively with a plurality of first and second through holes 235, 236 which are staggered with one another so that the first and second cavities 231, 232 can be communicated alternatively with the clearances 237 between the partition and press plates 233, 234, as best illustrated in FIGS. 4 and 5. The periphery of the lid member 23 has a plurality of holes 238 which are aligned respectively with the threaded holes 204 of the top edge of the casing 20. The cover plate 24 is disposed on the upper face of the lid member 23 in order to close the first and second cavities 231, 232. The cover plate 24 has holes 242 which are formed in its periphery and which correspond to the holes 238 of the lid member 23 so that the cover plate 24 and the lid member 23 can be secured to the open top of the casing 20 by threading screw members 208 through the holes 242, 238 and the threaded holes 204. The cover plate 24 further has first and second holes 241, 243 which are communicated receptively with the first and second cavities 231, 232. The first and second holes 241, 243 are connected to the connecting pipes 5 in order to allow the hydrogen and oxygen to flow into the gas tanks 4, respectively.

The electrolytic solution 6 is charged into the electrolytic tank 2 before the lid member 23 and the cover plate 24 are secured to the casing 20 so that the electrode plates 22 can be immersed fully in the electrolytic solution 6, as best illustrated in FIG. 6. The power supply unit 3 has positive and negative poles (not shown) which are connected electrically and respectively to two of the electrode plates 22 between which the other ones of the electrode plates 22 are located, as best illustrating in FIG. 3. Thereby, the hydrogen and oxygen can be produced electrolytically and respectively adjacent to the opposed faces of every two adjacent electrode plates 22 in each of the isolated sections 207. The hydrogen and oxygen will rise to the top surface of the electrolytic solution 6 and will enter respectively two clearances 237 on both sides of each of the partition plates 233. Therefore, the hydrogen and oxygen can pass respectively through the first and second holes 235, 226 into the first and second cavities 231, 232 and then are collected separately in the two gas tanks 4 through the first and second holes 241, 243.

It is noted that because the electrode plates 22 have corrugated surfaces, the overall surface area of the electrode plates 22 and therefore the contact surface area of the electrolytic solution 6 and the electrode plates 22 are increased. In addition, the electric current through the electrode plates 22 is increased due to the increasing of the overall surface area of the electrode plates 22. Therefore, the gas-producing efficiency can be enhanced.

Further, the corrugated configuration of the electrode plates 22 facilitates the vertical rise of the hydrogen and oxygen which are produced in the electrolytic solution 6. The apertures 211 of the insulating boards 21 can transfer effectively heat which is produced from the electrolytic reaction to the casing 20. Therefore, the heat can be dissipated through the heat-dissipating fins 200.

Figure 8:
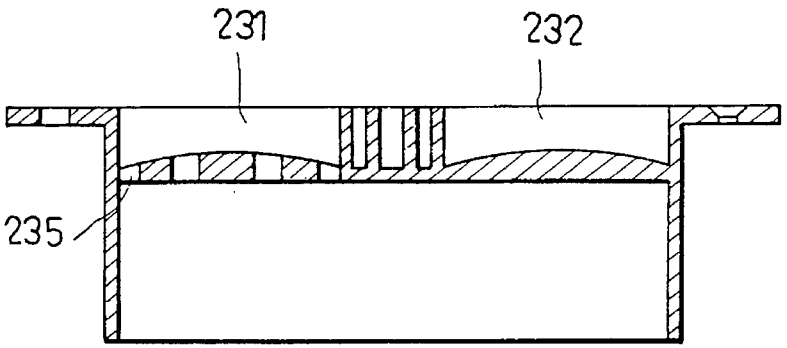
FIG. 8 is a cross sectional view of yet another preferred embodiment of the lid member according to the present invention.
Figure 7:
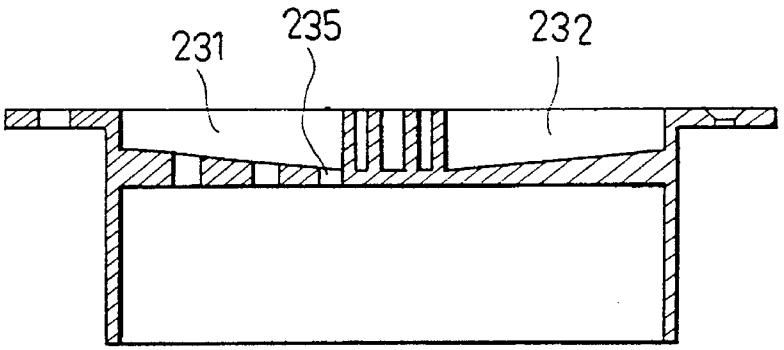
FIG. 7 is a cross sectional view of another preferred embodiment of the lid member according to the present invention.
Figure 9:
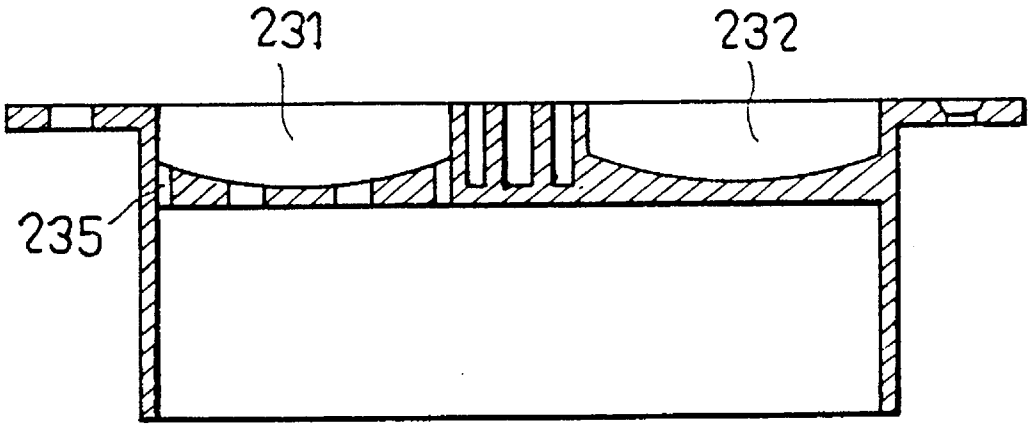
FIG. 9 is a cross sectional view of a still another preferred embodiment of the lid member according to the present invention.

Each of the bottom portions of the first and second cavities 231, 232 may be formed with an uneven face, such as a linearly inclined face as shown in FIG. 7, a convex face as shown in FIG. 8, and a concave face as shown in FIG. 9 in order to assure that the water condensed from the vapor in the first and second cavities 231, 232 can flow back into the isolated sections 207 of the electrolytic tank 2. In addition, an air-permeable filter material may be disposed in the first and second cavities 231, 232 in order to filter the gases which pass through first and second cavities 231, 232, reducing the amount of the water vapor. Furthermore, the top edge of each of the electrode plates 22 can have a rubber cap provided thereon in order to achieve an improved sealing effect between the abutting plates 234 and the electrode plates 22. It is understood that the apparatus of this invention can be used to collect separately any two gases other than the oxygen and hydrogen gases.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangement.

I claim:

1. An apparatus for producing electrolytically two gases and collecting separately said two gases, said apparatus comprising:

an electrolytic tank including a casing having an open top and a receiving space formed therein, a plurality of electrode plates spaced parallelly in said receiving space of said casing in order to divide said receiving space into a plurality of isolated sections arranged side by side in a direction, the electrode plates being configured and disposed for being fully immersed in an electrolyte solution, and a lid member disposed on said open top of said casing in order to close said open top, said lid member having upper and lower faces, elongated, parallel first and second cavities which are formed in said upper face of said lid member and which extend in said direction, each of said first and second cavities having a bottom portion, said lower face of said lid member having a looped wall depending therefrom, a region defined by said looped wall under said lower face of said lid member, a plurality of partition plates and press plates depending parallelly and alternatively from said lower face of said lid member within said region such that a plurality of clearances are formed between said partition and press plates, each of said press plates being aligned with and abutting against a top edge of a respective one of said electrode plates, each partition plate having a depth which is larger than a depth of each press plate so as to extend into a respective one of said sections defined by said electrode plates, said bottom portions of said first and second cavities being formed respectively with a plurality of first and second through holes which are staggered with one another so that said first and second cavities can be communicated alternatively with said clearances between said partition and press plates, said lid member further having a cover plate disposed on said upper face of said lid member in order to close said first and second cavities, said cover plate having first and second holes which are communicated receptively with said first and second cavities;

a power supply unit connected electrically to two of said electrode plates between which the other ones of said electrode plates are located; and two gas tanks, each having a connecting pipe which is connected to a corresponding one of said first and second holes of said cover plate.

2. An apparatus as claimed in claim 1, wherein said casing has two vertically opposed side walls, each of said side walls of said casing having an insulating board mounted thereto, each of said insulating boards having top and bottom edges, and a plurality of parallel grooves which extend from said top edge to said bottom edge thereof, each parallel groove of one of said insulating boards being aligned with a corresponding one of said parallel grooves of the other one of said insulating boards so that two opposite edges of each of said electrode plates can be inserted into two aligned parallel grooves of said insulating boards in order to hold said electrode plates in position, each of said insulating boards having a plurality of apertures which are formed between said parallel grooves.

3. An apparatus as claimed in claim 1, wherein each of said electrode plates is a corrugated plate.

4. An apparatus as claimed in claim 1, wherein each of said bottom portions has an uneven upper face.

5. An apparatus as claimed in claim 1, wherein said casing has an external face, and a plurality of heat-dissipating fins formed on said external face of said casing.

* * * * *